US007666033B1

(12) United States Patent
Fung

(10) Patent No.: US 7,666,033 B1
(45) Date of Patent: Feb. 23, 2010

(54) POWER PLUG WITH OVER TEMPERATURE AND OVER CURRENT PROTECTION

(75) Inventor: Kai Yu Fung, Hong Kong (CN)

(73) Assignees: Shen Daewood Electric (Shenzhen) Co., Ltd., Shenzhen (CN); Daewood Electrical Co., Ltd., Tsuen Wan (HK)

( * ) Notice: Subject to any disclaimer, the term of this patent is extended or adjusted under 35 U.S.C. 154(b) by 0 days.

(21) Appl. No.: 12/409,345

(22) Filed: Mar. 23, 2009

(30) Foreign Application Priority Data

Jan. 6, 2009 (CN) ..... 2009 2 0129129 U

(51) Int. Cl.
*H01R 13/68* (2006.01)

(52) U.S. Cl. ..... 439/620.26

(58) Field of Classification Search ..... 439/620.26, 439/620.3, 620.1, 620.13
See application file for complete search history.

(56) References Cited

U.S. PATENT DOCUMENTS 6,190,207 B1 * 2/2001 Wang ..... 439/620.31
2005/0197013 A1 * 9/2005 Chien ..... 439/622

FOREIGN PATENT DOCUMENTS

CN 201163690 12/2008

* cited by examiner

*Primary Examiner*—Javaid Nasri
(74) *Attorney, Agent, or Firm*—J.C. Patents

(57) ABSTRACT

A power plug with over temperature and over current protection comprises a housing, a plurality of terminals partially embedded in the housing, and a plurality of power cables. The housing is provided with an over temperature and over current protection unit therein. A live terminal of the power plug is directly and electrically connected with the protection unit by either pressing the live terminal immediately against the protection unit or directly welding the live terminal to the protection unit without any wire therebetween. The power plug provides a more direct and efficient heat transfer from the live terminal of the power plug to the protection unit, thereby response sensitivity of the protection unit can be enhanced.

5 Claims, 3 Drawing Sheets

POWER PLUG WITH OVER TEMPERATURE AND OVER CURRENT PROTECTION

CROSS-REFERENCE TO RELATED APPLICATION

This application claims the priority benefit of Chinese application serial no. 200920129129.7.1, filed Jan. 6, 2009. The entirety of the above-mentioned patent application is hereby incorporated by reference herein and made a part of specification.

FIELD OF THE INVENTION

The present invention relates to a power plug, and more particularly to a power plug which can provide protection against over temperature and over current conditions.

BACKGROUND OF THE INVENTION

A power plug with over temperature and over current protection is disclosed in CN patent No. 200720196044.1 which is issued as CN201163690 on Dec. 10, 2008 to the assignee of the present application and incorporated herein in its entirety by reference. Referring to FIGS. 1 and 2, the power plug comprises a housing 1, terminals 2, 3 and 4 partially embedded in the housing 1, and power cables 5, 6 and 7. The terminal 2 is a live terminal. An over temperature and over current protection unit 100 is provided inside the housing 1 and connected in series between the terminal 2 and the power cable 5 of the power plug. Referring to FIG. 2 which shows an interior structure of the power plug, the protection unit 100 has a bimetallic strip 40 located at a side close to a metal shell 20, and a thermistor 50. An electrical connection end, on which a wiring card 24 is disposed, extends from the metal shell 20 and is electrically connected to the live terminal 2 through a conductive wire 80, which is in turn received and held by a second wiring card 70. The power plug can provide protection against over temperature and over current conditions.

However, the live terminal 2 of the power plug mentioned above is connected to the electrical connection end of the protection unit 100 through a conductive wire. Due to the presence of other materials, such as plastic of the power plug, the conductive wire and the wiring card, between the live terminal and the protection unit, heat can not be directly transferred from the live terminal to the protection unit, thus heat transfer efficiency and response speed of the protection unit are reduced.

SUMMARY OF THE INVENTION

The present invention aims to provide a power plug with over temperature and over current protection that can transfer heat directly and efficiently from a live terminal to a protection unit of the power plug.

To realize the above aims, the present invention provides a power plug with over temperature and over current protection. The power plug comprises a housing, a plurality of terminals partially embedded in the housing, and a plurality of power cables. The housing is provided with a protection unit therein, and a live terminal of the power plug is directly and electrically connected with the protection unit.

The protection unit is provided with a metal shell, and the live terminal is immediately pressed against and electrically connected with the metal shell.

The protection unit is provided with a metal shell, and the live terminal is directly welded on the metal shell.

The protection unit comprises a bimetallic strip and a thermistor in parallel connected at two ends of the bimetallic strip.

The live terminal is directly and electrically connected to the metal shell at a side close to the bimetallic strip.

The power plug comprises two, three, four or five terminals.

The power plug has a shape of 90 degrees or 180 degrees.

The merit of the present invention lies in that electrical connection between the live terminal and the metal shell of the protection unit is realized through immediately pressing them against each other or even through welding them together without any medium therebetween. The heat transfer is more direct and efficient, and the response of the protection unit is faster and more sensitive. In addition, the protection unit has a compact structure which may be used in power plugs of various shapes and structures.

Depending on various requirements of the power plug in use, voltage and current of the protection unit can be chosen in a wide range in order to comply with required electric parameters of the power plug. Temperature of the protection unit can be chosen and achieve a minimum cut-out temperature of 45° C. (±5, ±8, ±10).

BRIEF DESCRIPTION OF THE DRAWINGS

The present invention will now be described more fully hereinafter through various embodiments with reference to accompanying drawings, in which.

DETAILED DESCRIPTION OF THE PREFERRED EMBODIMENT

Figure 1:
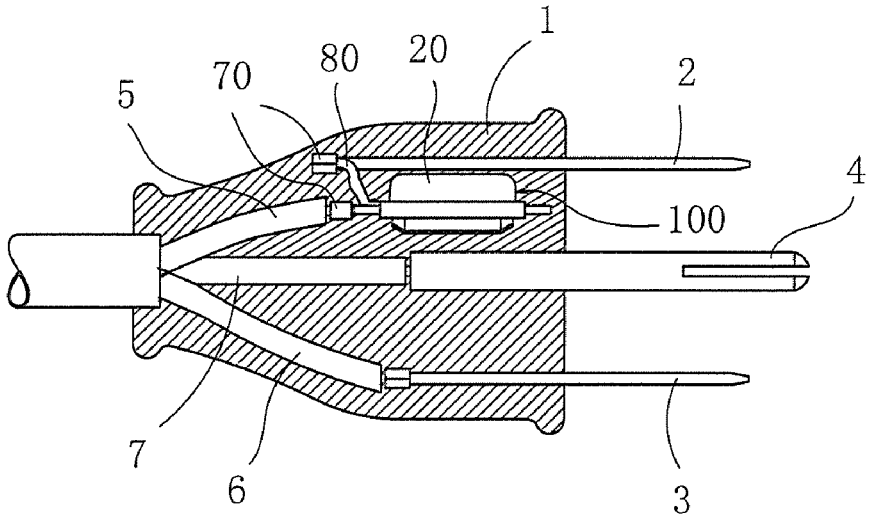
Fig 1 PRIOR ART
FIG. 1 is a sectional view of a power plug with over temperature and over current protection in prior art.
Figure 2:
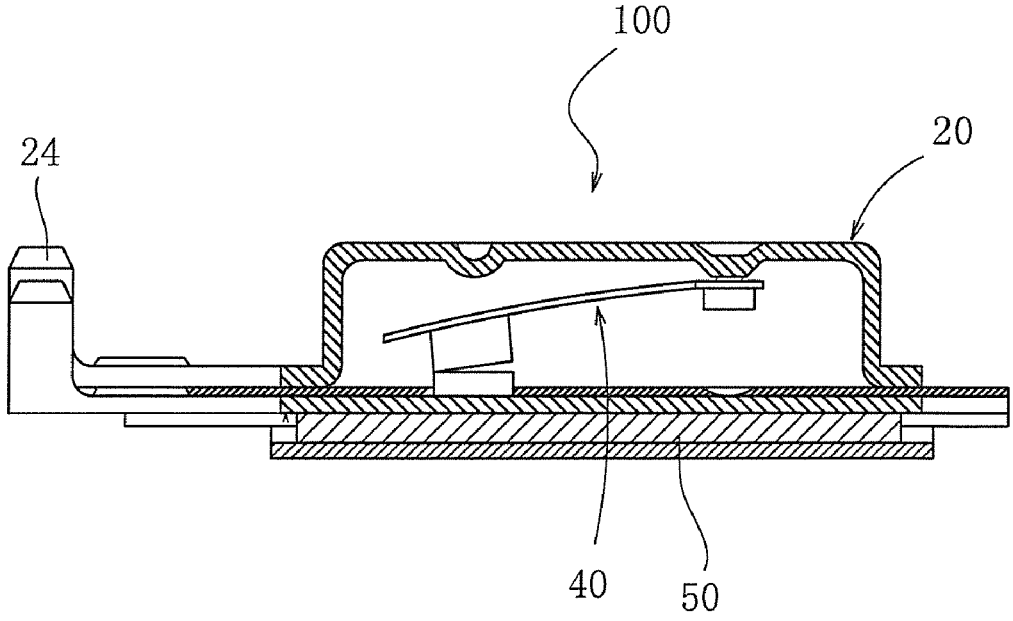
Fig 2 PRIOR ART
FIG. 2 is a sectional view of a protection unit shown in FIG. 1.
Figure 3:
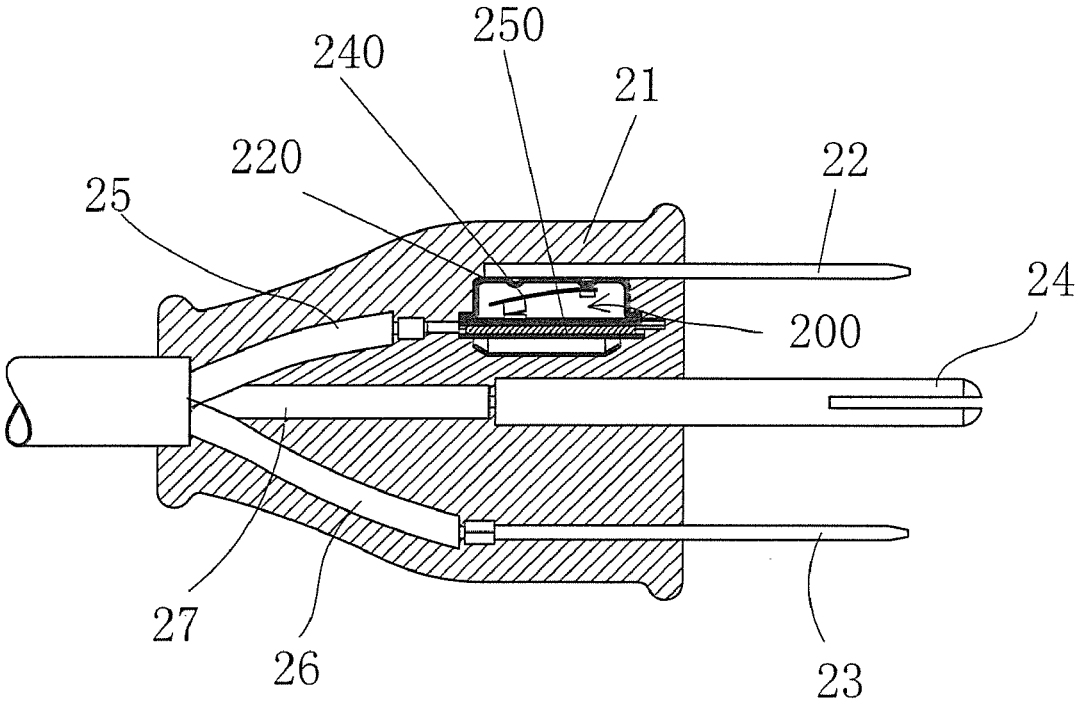
FIG. 3 is a sectional view of a power plug according to the first embodiment of the present invention.

As shown in FIG. 3, a power plug according to the first embodiment of the present invention is illustrated. Shown in FIG. 3 is a power plug with three terminals, and comprises a housing 21, terminals 22, 23 and 24 partially embedded in the housing, and power cables 25, 26 and 27. The terminals 22, 23 and 24 are a live terminal 22, a neutral terminal 23 and a ground terminal 24, respectively. The power cables 25, 26 and 27 are a live line 25, a neutral line 26 and a ground line 27, respectively. A protection unit 200 having a metal shell 220 is provided inside the housing of the power plug. The protection unit 200 comprises a bimetallic strip 240 and a thermistor 250 which are the same as the bimetallic strip 40 and the thermistor 50 shown in FIG. 2. The live terminal 22 of the power plug is in direct and physical contact with and electrical connection to the metal shell 220 at a side close to the bimetallic strip without any wire. The connection may be realized through pressing the live terminal 22 immediately against the metal shell 220 or through directly welding the live terminal 22 to the metal shell 220.

Figure 4:
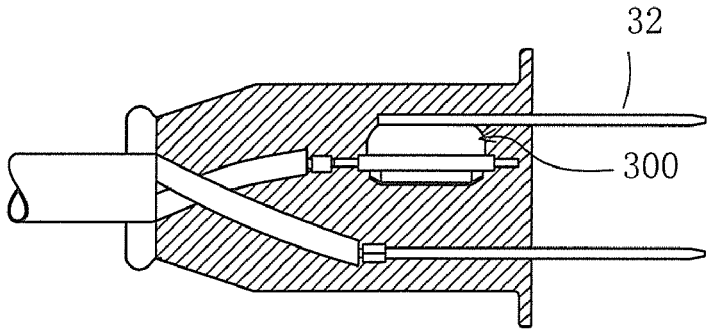
FIG. 4 is a sectional view of a power plug according to the second embodiment of the present invention.

As shown in FIG. 4, a power plug according to the second embodiment of the present invention is illustrated. The connection between the live terminal 32 and the protection unit

300 shown in FIG. 4 is the same as that in the first embodiment, except that the power plug shown in FIG. 4 is provided with two terminals.

Figure 5:
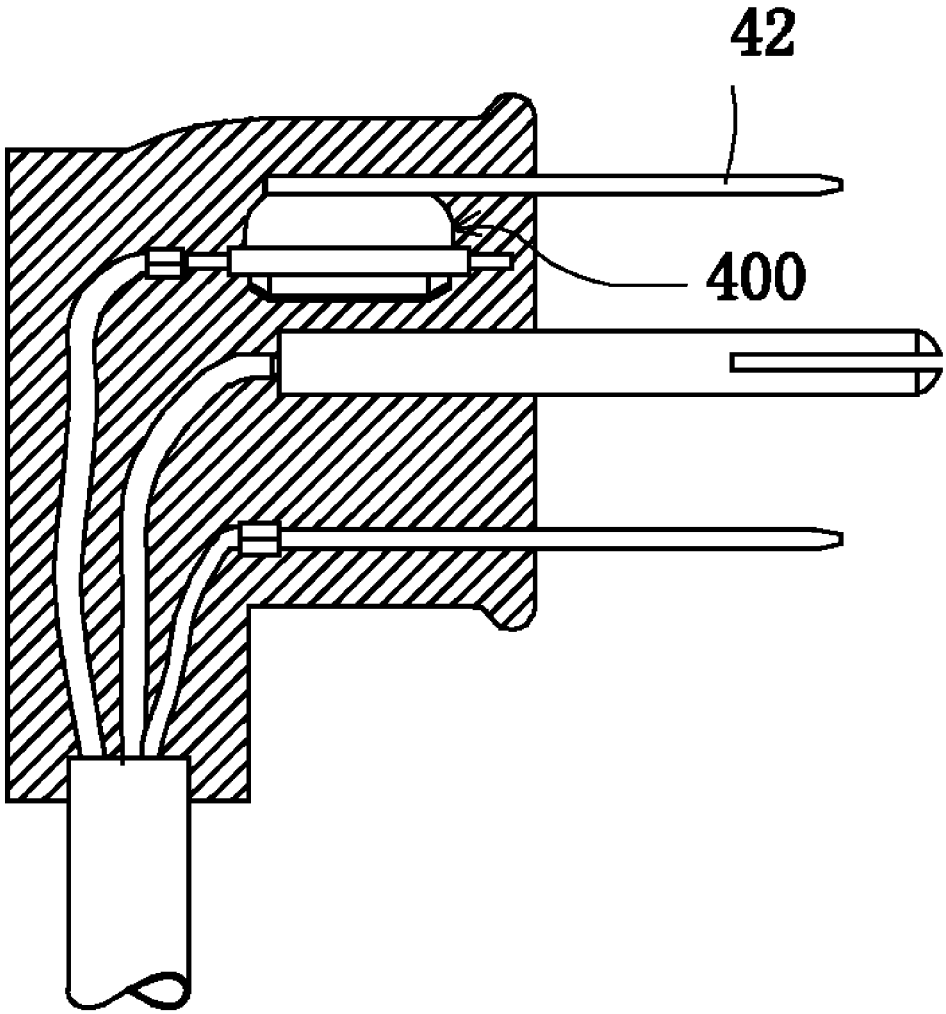
FIG. 5 is a sectional view of a power plug according to the third embodiment of the present invention.

As shown in FIG. 5, a power according to the third embodiment of the present invention is illustrated. The connection between the live terminal 42 and the protection unit 400 shown in FIG. 5 is the same as that in the first embodiment, except that the power plugs shown in the first and second embodiments have a shape of 180 degrees, in which the angle between the terminals and the power cable 8 is configured to be 180 degrees, and the power plug in the present embodiment has a shape of 90 degrees.

The application of the present invention is not limited to the terminal number, angle, shape, structure and specification of the power plug. The present invention may be widely used in power plugs with four or five terminals, and may also be used in power plugs of round shape, square shape or any of the combination.

The invention claimed is:

1. A power plug with over temperature and over current protection, comprising a housing, a plurality of terminals which comprise a live terminal partially embedded in the housing, and a plurality of power cables, wherein the housing is provided with an over temperature and over current protection unit which comprises a bimetallic strip and a thermistor therein, and the live terminal of the power plug is directly and physically contacted and electrically connected with a side of the protection unit which is close to the bimetallic strip without any wire.

2. The power plug of claim 1, wherein the protection unit comprises a metal shell, and the live terminal is pressed immediately against and electrically connected with the metal shell.

3. The power plug of claim 1, wherein the protection unit comprises a metal shell, and the live terminal is directly welded on the metal shell.

4. The power plug of claim 1, wherein the power plug comprises two or three terminals.

5. The power plug of claim 1, wherein the power plug has a shape of 90 degrees or 180 degrees.

* * * * *